United States Patent [19]

Dutt

[11] Patent Number: 4,461,393

[45] Date of Patent: Jul. 24, 1984

[54] CLOSURE CAP

[75] Inventor: Herbert V. Dutt, Sarasota, Fla.

[73] Assignee: Sun Coast Plastics, Inc., Sarasota, Fla.

[21] Appl. No.: 485,533

[22] Filed: Apr. 15, 1983

[51] Int. Cl.[3] ..... B65D 53/00

[52] U.S. Cl. ..... 215/329; 215/345; 215/DIG. 1

[58] Field of Search ..... 215/329, 343, 345, DIG. 1

[56] References Cited

U.S. PATENT DOCUMENTS

| | | | |
|---|---|---|---|
| 3,473,683 | 10/1969 | Zipper | 215/345 |
| 4,143,785 | 3/1979 | Ferrell | 215/DIG. 1 |
| 4,308,965 | 1/1982 | Dutt | 215/345 |

*Primary Examiner*—Donald F. Norton

*Attorney, Agent, or Firm*—Jones, Tullar & Cooper

[57] ABSTRACT

A closure cap for a container with enhanced sealing capability including a sealing member which is uniquely structurally arranged for optimum sealing without the need for excessive torque applications.

9 Claims, 2 Drawing Figures

CLOSURE CAP

BACKGROUND OF THE INVENTION

1. Field of the Invention

The present invention relates to closure caps in general, and in particular to closure caps which have improved sealing capability. The caps can be categorized as unitary caps having two dissimilar materials for sealing purposes.

2. Prior Art

A closure cap which provides a vacuum seal for containers, and especially for containers of varying wall thickness and irregularities, such as chips and the like around the rim of the container, is known from U.S. Pat. No. 4,143,785. In this patent, the closure cap is disclosed as including a pair of flexible annular flanges adapted to engage the inner and outer edges of the upper rim of the container to be closed to provide a vacuum seal when the cap is placed on the container. The two flanges are concentrically arranged, with the outer flange being canted outwardly and the inner flange being canted inwardly. This angled arrangement provides for a line contact rather than a surface contact with the container rim. The two flanges are disclosed as working independently to produce the desired contact. An improvement over this closure cap is found in U.S. Pat. No. 4,308,965. In this latter patent, the closure cap is disclosed as constructed of two dissimilar plastic materials forming a substantially rigid outer member and a substantially resilient inner sealing member, with the inner sealing member being anchored to the outer member. The use of two dissimilar materials in the manner described in the latter noted patent is referred to as a two-shot design. Like the cap disclosed in the 4,143,785 patent, the closure cap disclosed in the 4,308,965 patent includes a pair of flexible annular flanges adapted to engage the inner and outer edges of the upper rim of the container to be closed to provide a vacuum seal when the cap is placed on the container. This design is intended to have the same range of application in terms of container sizes as that disclosed in the 4,143,785 patent, and it was believed that the spacing of two flanges with respect to each other and the top wall of the container was not critical due to the resiliency of the flanges. For this reason, the particular configuration of the design disclosed in the 4,038,965 patent was dictated primarily by fabrication considerations rather than by any dimensional considerations. In fact, it has been found that the intended range of application of this design is limited, and while it is not clear why this is so, corrective action was deemed warranted since this design has proved quite successful for a limited range of container sizes.

It would therefore be desirable to enhance the two-shot design disclosed in the 4,308,965 patent by giving it a greater range of application.

OBJECTS AND SUMMARY OF THE INVENTION

One object of the present invention is to provide an optimized closure cap with respect to sealing capability.

A related object of the present invention is to achieve the optimization noted in the previously stated object with a closure cap having two dissimilar materials.

While the flanges disclosed in the 4,143,785 patent work independently of each other, those disclosed in the 4,308,965 patent apparently do not. This conclusion was reached from a consideration of the mass distribution of the sealing member defining the flanges relative to its mounting within the top wall of the cap. As the flanges extend from their free ends toward the top wall of the cap, they reach a merger region below the top wall which provides a bridge between the flanges for mutual load transfer. While the mutual effect on the flanges can be predicted because of the bridge, why such a bridge should have an effect on restricting the application of the two-shot design to different sized containers is not clear.

It is believed that the hardness of the sealing member material is a factor in the noted restriction. One would have expected that hardness would not have been a factor because of the possibility of torque adjustment. However, it has been observed that the hardness of the material must vary as the size of the cap varies in order to control container penetration into the sealing member, i.e., the amount of movement of the container from the time it initially contacts the flanges. Too much penetration (soft material) could require excessive torque for cap removal and prevent venting (e.g., where the container holds a carbonated beverage) before the threaded engagement is removed, whereas too little penetration (hard material) could adversely affect the seal intended.

Dimensional control due to mass orientation and hardness control are factors which, it is now found must be considered in a two-shot design. An optimized design has been reached utilizing an empirical approach. Various tests were conducted using a two-shot design. It was found that as the container size increased, that is, as the size of the container opening to be closed increased, the sealing member widened, as would be expected, but its thickness and hardness factors had to be reduced in order to achieve a consist sealing capability without excessive torque requirements. This was not expected, but it was found to be necessary to insure a proper penetration of the sealing member by the inside and outside edges of the container. The physical cross sectional mass of the sealing member had to be reduced as the closure size increased to control too high removal torques and too slow venting through restricting container edge penetration.

BRIEF DESCRIPTION OF THE DRAWINGS

Two figures have been selected to illustrate a preferred embodiment of the present invention. These are.

DETAILED DESCRIPTION

Figure 1:
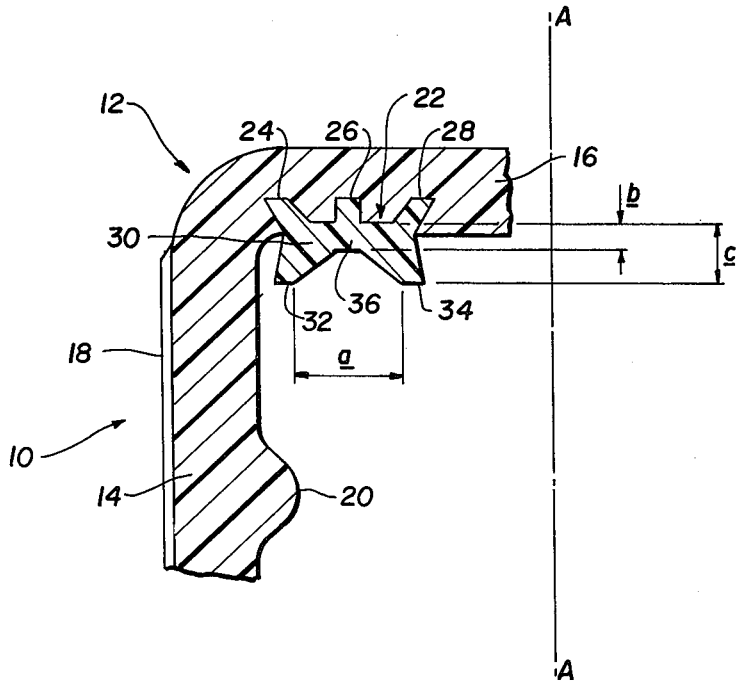
FIG. 1, which is a partial view in cross-section of a closure cap which features an enhanced two-shot design.

A portion of a closure cap 10 of a unitary two-shot design is illustrated in FIG. 1. It includes a substantially rigid outer closure member 12 comprising an annular side wall 14 and a transverse top wall 16. The outside surface of the side wall 14 is provided with serrations 18 which extend outwardly from the outside surface to provide a gripping surface for ease of torque application. The inside surface of the side wall 14 is provided with a thread 20. The closure cap 10 also includes an annular sealing member 22 which is secured to the transverse top wall 16 by an arrangement of outwardly extending ribs 24, 26, and 28, referred to collectively as the anchor. The sealing member 22 also includes a base portion 30 from which the ribs 24, 26, and 28 extend, and from which two transversely spaced sealing flanges 32 and 34 also extend, but in an opposite direction to that of the ribs 24, 26, and 28. The base portion 30 defines a merger region 36 which provides a bridge between the flanges 32 and 34. The outer flange 32 is spaced from the side wall 14 a distance sufficient to prevent contact there between when the cap has been applied to a container. In addition, the flanges 32 and 34 are so angled and the distance between them is such that the flanges will engage only the rim edges and the top surface of the wall of a container to which the cap is applied.

Figure 2:
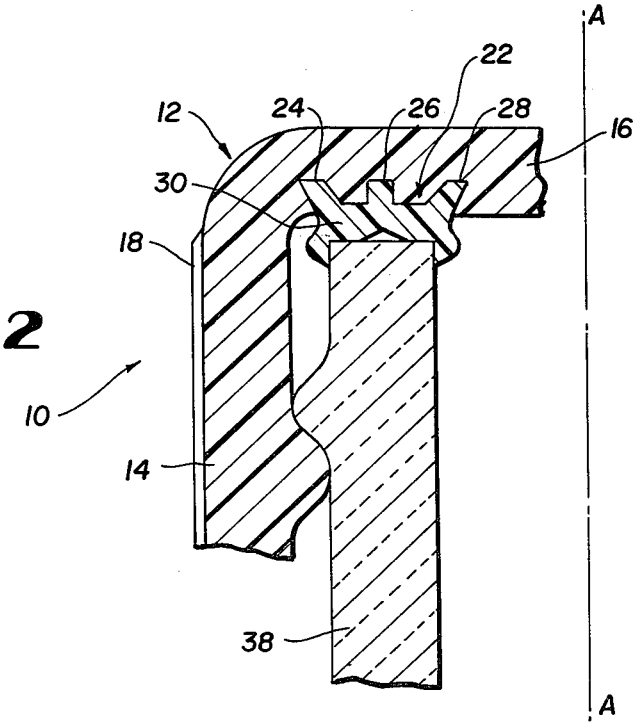
FIG. 2, which illustrates the closure cap of FIG. 1 in combination with a container.

The sealing member 22 serves the same purpose as do the sealing members disclosed in the previously noted patent 4,308,965, except that the sealing member 22 constructed in accordance with the present invention provides the cap 10 with an enhanced sealing capability. To demonstrate, consider the results of a recently completed test program conducted with containers 38 (FIG. 2) of varying opening diameters. The outer closure member 12 was increased in size to accomodate the container. The diameter of the sealing member 22 was correspondingly increased but the dimensions a, b, and c (FIG. 1) remained constant as it was believed that a good sealing capacity could be achieved with these dimensions held constant. The closure member 12 was made of polypropylene, while the sealing member 22 was made of a thermoplastic rubber material. It was observed that a constantly dimensioned sealing member 22 did not in fact provide adequate sealing capability for different sized containers. Surprisingly, it was learned that the hardness of the sealing member 22 had to be reduced and the dimensions a, b, and c adjusted to achieve optimized results. The optimized parameters developed were as follows:

| Closure Cap Diameter (mm) | Shore A Hardness Sealing Member 22 | a (in) | b (in) | c (in) | Torque Appli./Remov. (in-lbs.) |
|---|---|---|---|---|---|
| 18–38 | 58 | .120 | .055 | .085 | 15–25/10–20 |
| 43–58 | 53 | .130 | .047 | .077 | 25–35/15–25 |
| 63–83 | 48 | .140 | .039 | .068 | 35–45/20–30 |
| 83–110 | 43 | .150 | .031 | .057 | 45–55/25–35 |

The closure cap diameters reflect the diameter ranges of the openings of a majority of the containers on the market. These ranges represent container families in which the design characteristics ar similar; e.g., wall thickness. The dimension a represents the tranverse distance between the inner facing edges of the flanges 32 and 34, while the dimension b represents the longitudinal (i.e., in the direction along axis A—A) thickness of the base portion 30 (first longitudinal thickness) and the dimension c represents the longitudinal thickness of the base portion 30 either of the flanges 32 or 34 (second longitudinal thickness). Note that in accordance with the invention, b is no greater than approximately 50% of a, that b is no greater than approximately 65% of c, and that c is no greater than approximately 75% of a. Note that the Shore A hardness is approximately a linear function of each dimensional group with b being no greater than approximately 40% of a for a Shore A hardness of less than 55, b being no greater than approximately 30% of a, and approximately 60% of c for a Shore A hardness of less than 50. It was furthermore observed that the Shore A hardness was reduced by approximately 10% between the various ranges noted and that this decrease had the effect of increasing the dimension a by 7–8%, and decreasing b by 15–20% and c by 10–15% between the various ranges.

With these relationships of the dimensions a, b, and c, it is found that the container 36 always penetrates the sealing member 22 sufficiently and the sealing member 22 responds by conforming to the edges of the container so that a seal is created without the need for the application of excessive torque. It is believed that the mass of the sealing member 22, which the noted dimensional relationships create, is truly optimized so that greater ranges of containers can confidently be provided for, and appropriate seals produced.

A closure cap with an outer closure member 12 and sealing member 22 can be made by well known techniques of two-shot injection molding. Any further discussion of these techniques should be unnecessary to the skilled person in the art.

I claim:

1. A closure cap for containers, comprising:

a substantially rigid outer closure member defining a longitudinal axis and having a transverse top wall and an annular side wall depending from the perimeter of said transverse top wall and integrally formed therewith and defining an open end thereof; and a resilient inner sealing member secured to the transverse top wall of the outer closure member, said inner sealing member including a base portion from which a pair of transversely spaced apart flanges extend, said base portion defining a first longitudinal thickness and a second longitudinal thickness with each of said flanges, wherein:

(i) the first longitudinal thickness is not greater than approximately 50% of the transverse distance between the flanges; and (ii) the first longitudinal thickness is no greater than approximately 65% of the second longitudinal thickness.

2. The closure cap as defined in claim 1, further wherein:

(iii) the second longitudinal thickness is no greater than approximately 75% of the transverse distance between the flanges.

3. The closure cap as defined in claim 1, further wherein for a hardness of said inner sealing member of less than a Shore A hardness of 55:

(iii) the first longitudinal thickness is no greater than approximately 40% of the transverse distance between the flanges.

4. The closure cap as defined in claim 1, further wherein for a hardness of said inner sealing member of less than a Shore A hardness of 50:

(iii) the first longitudinal thickness is no greater than approximately 30% of the transverse distance between the flanges; and (iv) the first longitudinal thickness is no greater than approximately 60% of the second longitudinal thickness.

5. The closure cap as defined in claim 1, further wherein:

(iii) said inner sealing member further includes anchoring means for securing the inner sealing member to the top wall of the outer closure member.

6. The closure cap as defined in claim 5, further wherein:

(iv) said anchoring means comprises an anchoring member disposed substantially perpendicular to said base portion and a pair of anchoring members disposed angularly relative to said base portion on opposite sides of said substantially perpendicular anchoring member.

7. The closure cap as defined in claim 1, further wherein:

(iii) one of said flanges is spaced from said side wall a distance sufficient to prevent contact therebetween when the cap has been applied to a container.

8. The closure cap as defined in claim 7, further wherein:

(iv) the flanges are so angled and the distance between them is such with respect to said top wall that the flanges will engage only the rim edges and top surface of the wall of a container to which the cap is applied.

9. The closure cap as defined in claim 1, further wherein:

(iii) the annular side wall defines a thread on its inner surface.

* * * * *